US007555854B2

(12) United States Patent
Hatakeyama

(10) Patent No.: US 7,555,854 B2
(45) Date of Patent: Jul. 7, 2009

(54) EARTH AUGER HEAD AND EXCAVATION METHOD

(75) Inventor: Masaki Hatakeyama, Niigata (JP)

(73) Assignee: MLT Soil Co., Ltd., Niigata (JP)

( * ) Notice: Subject to any disclaimer, the term of this patent is extended or adjusted under 35 U.S.C. 154(b) by 0 days.

(21) Appl. No.: 11/947,082

(22) Filed: Nov. 29, 2007

(65) Prior Publication Data

US 2008/0127528 A1 Jun. 5, 2008

(30) Foreign Application Priority Data

Nov. 30, 2006 (JP) ..... 2006-323585
Oct. 15, 2007 (JP) ..... 2007-267403

(51) Int. Cl.
*E02F 3/10* (2006.01)
*E21B 4/00* (2006.01)

(52) U.S. Cl. ..... 37/350; 37/189; 175/296; 175/323; 175/262

(58) Field of Classification Search ..... 37/350, 37/189, 352, 364; 175/394, 395, 56, 323, 175/257, 246, 262, 293, 295, 296
See application file for complete search history.

(56) References Cited

U.S. PATENT DOCUMENTS 1,932,239 A * 10/1933 Berry ..... 408/67
2,694,551 A * 11/1954 Snyder ..... 175/56
2,847,188 A * 8/1958 Wiltse ..... 173/150
3,219,131 A * 11/1965 Boyd ..... 175/92
3,241,624 A * 3/1966 Rassieur ..... 175/257
3,565,190 A * 2/1971 Ishii ..... 175/171
3,565,351 A * 2/1971 Ross et al. ..... 241/99
3,572,449 A * 3/1971 Brocas et al. ..... 175/57
3,794,127 A * 2/1974 Davis ..... 175/58
3,957,125 A * 5/1976 Russell, Jr. ..... 173/150
4,016,944 A * 4/1977 Wohlfeld ..... 175/92
4,061,197 A * 12/1977 Skidmore, Jr. ..... 175/101
4,098,012 A * 7/1978 Parrish ..... 37/351
4,253,531 A * 3/1981 Boros ..... 175/56

(Continued)

FOREIGN PATENT DOCUMENTS

JP 61083718 A * 4/1986

(Continued)

*Primary Examiner*—Thomas A Beach
(74) *Attorney, Agent, or Firm*—Sughrue Mion, PLLC

(57) ABSTRACT

It is an object of the present invention to provide a more efficient and economically superior earth auger head in which a percussive excavation mechanism part (down-the-hole hammer) is incorporated in order to break up portions that are unsuitable for rotary excavation by the auger, and an excavation method using this auger head. The auger head comprises a rotary excavation mechanism part (1) in which a spiral vane (12) used for earth discharge is provided to the circumferential surface of a rotary tubular part (11), and in which an excavating bit (13) whose outer circumferential side protrudes further downward than the central side is provided to the lower end of this spiral vane; and further comprises a pneumatic percussive excavation mechanism part (2) that is installed inside the rotary tubular part and is disposed so that a percussive body (23) is accommodated in a position that is higher than the lower tip end of the excavating bit. The rotary excavation mechanism part and percussive excavation mechanism part are each independently driven and controlled.

6 Claims, 3 Drawing Sheets

U.S. PATENT DOCUMENTS

| | | | | | |
|---|---|---|---|---|---|
| 4,474,252 | A | * | 10/1984 | Thompson | 175/69 |
| 4,958,690 | A | * | 9/1990 | Cyphelly | 175/296 |
| 5,156,223 | A | * | 10/1992 | Hipp | 175/296 |
| 5,305,837 | A | * | 4/1994 | Johns et al. | 175/61 |
| 5,568,838 | A | * | 10/1996 | Struthers et al. | 175/246 |
| 6,978,849 | B2 | * | 12/2005 | Sherwood | 175/57 |
| 2008/0179101 | A1 | * | 7/2008 | Mash | 175/325.1 |

FOREIGN PATENT DOCUMENTS

| | | | | |
|---|---|---|---|---|
| JP | 03107090 | A | * | 5/1991 |
| JP | 3004848 | U | | 9/1994 |
| JP | 06323078 | A | * | 11/1994 |
| JP | 0791930 | B2 | | 10/1995 |
| JP | 09177462 | A | | 7/1997 |
| JP | 10159474 | A | | 6/1998 |
| JP | 2002295158 | A | | 10/2002 |

* cited by examiner

EARTH AUGER HEAD AND EXCAVATION METHOD

BACKGROUND OF THE INVENTION

1. Field of the Invention

The present invention relates to an earth auger head and an excavation method using this earth auger head.

2. Description of the Related Art

In common earth auger heads, a spiral vane (screw) for discharging excavated earth is disposed on the tip part of a rotating shaft, and a bit used to excavate the ground is installed on the lower end part. The boring of holes is accomplished by the rotation of the abovementioned excavating bit (rotational excavation). In the hole boring excavation (rotational excavation) performed by the abovementioned earth auger head, when hard ground is struck during the excavation, the destruction of the ground by the excavating bit no longer proceeds. Accordingly, an excavating operation is again performed once the hard ground has been removed.

Furthermore, excavation means (percussive excavation) is known in which hole boring is performed by applying a strong shock to the ground and pulverizing the ground using an air pressure percussive excavation drill (down-the-hole hammer or the like) as means for handling hard ground excavation (Japanese Examined Patent Publication No. 7-91930). The above-mentioned percussive excavation is effective against hard ground, but the excavation efficiency is poor in the case of hole boring excavation performed on ordinary ground.

Accordingly, in order to incorporate the advantages of rotary excavation and percussive excavation, it has been proposed that an air pressure percussive type excavation drill (down-the-hole hammer or the like) be built into the earth auger head.

For example, in Japanese Registered Utility Model No. 3004848, Japanese Laid-Open Patent Application No. 9-177462, and Japanese Laid-Open Patent Application No. 10-159474, earth auger heads are disclosed in which the rotary shaft of the earth auger head is formed in a tubular shape, and a down-the-hole hammer is disposed inside this rotary tube.

Furthermore, in cases where a reinforced concrete block is formed by filling the excavated hole with a concrete block and inserting an iron reinforcing basket, the excavated hole is filled with a foot protection liquid such as cement milk or the like prior to the construction of this block.

The filling operation of this foot protection liquid requires the filling to be performed while the destruction of the excavated hole is prevented, and must therefore be performed while the earth auger is being withdrawn. Accordingly, in an earth auger head which is capable of performing both the abovementioned rotary excavation and the above-mentioned percussive excavation, both a high pressure air supply path and a liquid supply path are formed in the excavating rod as indicated in Japanese Examined Patent Publication No. 7-91930 and Japanese Registered Utility Model No. 3004848, a liquid jet opening is formed in the auger head, and successive filling with a foot protection liquid is performed from the bottom of the hole while the earth auger is withdrawn following the completion of excavation.

Furthermore, in Japanese Registered Utility Model No. 3004848, a switching valve mechanism which is switched by the weight of the auger head and the pushing in of the excavating rod is interposed between the excavating rod and the auger head, and the high pressure air supply path also acts as a liquid supply path.

SUMMARY OF THE INVENTION

When the installation position of the down-the-hole hammer in the abovementioned earth auger heads is examined, it is seen that in Japanese Laid-Open Patent Application No. 10-159474, the rotary excavating bit and down-the hole hammer are formed on the same plane; accordingly, even if only rotary excavation by the earth auger head is performed without driving the down-the-hole hammer, the head of the down-the-hole hammer constitutes excavating resistance. Consequently, effective hole boring excavation cannot be accomplished unless both rotary excavation by the excavating bit of the auger head and percussive excavation by the hammer are always performed simultaneously.

Furthermore, in the earth auger heads of Japanese Registered Utility Model No. 3004848 and Japanese Laid-Open Patent Application No. 9-177462 as well, the down-the-hole hammer part protrudes further downward than the position of the excavating bit of the auger head; accordingly, in concrete terms, hammer percussive excavation is the main excavation.

However, a percussive excavation mechanism (down-the-hole hammer) is installed in order to break up portions that are intrinsically unsuitable for rotary excavation by the earth auger; accordingly, in ground that can be excavated by ordinary auger excavation, the installation of a percussive excavation mechanism conversely leads to a drop in the percentage of a hole that can be excavated.

Furthermore, in the foot protection liquid supply structure as well, in the combined installation of a high pressure air supply path and liquid supply path disclosed in Japanese Examined Patent Publication No. 7-91930 and Japanese Laid-Open Patent Application No. 9-177462, a sealed connection of both supply paths is required in the connection with the excavating rod and coupling of the excavating rod, and the connection of two tubes or connection of a double tube in a member having a considerable weight is extremely bothersome.

Furthermore, in an operation in which only the simple formation of an excavated hole is required and the supply of a foot protection liquid is not performed, the above-mentioned connection of two tubes or connection of a double tube is wasted work.

Furthermore, in the case of a structure using a single supply path and a switching valve as in the earth auger disclosed in Japanese Registered Utility Model No. 3004848, the connection with the abovementioned excavating rod and the like is relatively straightforward; however, if a structure is employed in which the excavation operation is switched by the downward movement of the auger head caused by the weight of the head and the upward movement of the head caused by the pushing in of the excavating rod, the excavation work involves the upward and downward movement of the percussive body; accordingly, the work is not always limited to a state in which the head is constantly pushed in (a state of movement toward the excavating rod). Consequently, cases may occur in which the auger head reaches a position that is separated from the excavating rod; in such cases, there is a high possibility that excavated soil will be entrained, producing a state in which the switching valve is connected to the liquid jet side, making it impossible to accomplish not only percussive excavation, but also rotary excavation by the excavating bit positioned higher than the percussive body.

Thus, in a switching structure depending on the relative positions of the auger head, in cases where the auger head position during excavation work reaches an unstable state, there is a danger that the excavation work itself will not proceed, and the apparatus itself becomes expensive as a result of the use of a complex structure.

Accordingly, the present invention provides an earth auger head that is capable of effective percussive excavation and that also allows the reliable supply of a foot protection liquid, and a novel excavation method using this auger head.

The earth auger head of the present invention according to a first aspect comprises a rotary excavation mechanism part in which a spiral vane used to discharge earth is provided to an outer circumference of a rotary tubular part, and in which an excavating bit whose outer circumferential side protrudes further downward than the central side is provided to a lower end of the spiral vane; and further comprises a pneumatic percussive excavation mechanism part that is installed inside the rotary tubular part and is disposed so that a percussive body is accommodated in a position that is higher than the lower tip end of the excavating bit.

Furthermore, the excavation method of the present invention according to a fifth aspect is a method comprising forming an earth auger by connecting a prescribed excavating rod with an earth auger head having a rotary excavation mechanism part that is provided with an excavating bit, and further having a percussive excavation mechanism part that is inserted within the rotary tubular part. When hole boring excavation is performed using this earth auger, the rotary excavation mechanism part and percussive excavation mechanism part are each independently driven and controlled.

Furthermore, in the abovementioned earth auger head, an earth auger is constructed by mounting the head on the tip end of an excavating rod in the same manner as in conventional excavation methods, and the earth auger is suspended from a specified variety of heavy machinery or the like together with a rotary driving mechanism, and hole boring excavation is performed with driving air supplied utilizing a piping path installed inside the excavating rod. Hole boring excavation of ordinary ground is performed by rotary excavation using an excavating bit. When hard ground is struck, percussive excavation using a percussive body is also performed, and the overall excavation efficiency is heightened.

Furthermore, the earth auger head of the present invention according to a third aspect is constructed as follows. Namely, in the abovementioned earth auger head, an excavating rod connecting part is provided to the upper part of the rotary tubular part of the rotary excavation mechanism part, a high pressure air supply path is formed communicating between the connecting part and a high pressure air supply part in the internally installed percussive excavation mechanism part, a switching valve that is operated by an external operation is disposed at an intermediate point along the high pressure air supply path, and a liquid discharge path is formed so as to open on the outer circumference of the rotary tubular part connected with the high pressure air supply path via the switching valve.

Furthermore, the excavation method of the present invention of a sixth aspect using the abovementioned earth auger head is a method in which the earth auger is withdrawn from the excavated hole after the excavated hole is excavated, the switching valve is operated so that the high pressure air path and liquid discharge path are caused to communicate, the earth auger is again lowered to the bottom of the excavated hole, a foot protection liquid such as cement milk or the like is supplied to the high pressure air supply path, and the foot protection liquid is discharged into the excavated hole while the earth auger is withdrawn.

Accordingly, during the excavation work of the excavated hole, no impediment occurs when the switching valve is in a fixed state, and the auger is temporarily pulled up (in cases where the injection of a foot protection liquid is not required, the process ends with this pulling-up operation); the switching valve of the auger head is switched with the excavating rod in a connected state, the earth auger is again stood in the excavated hole, a foot protection liquid such as cement milk or the like is supplied to the high pressure air supply path from above the ground, and the foot protection liquid is discharged into the excavated hole while the earth auger is withdrawn, so that the hole is filled with the foot protection liquid in a state in which the excavated hole is maintained.

The present invention is constituted as described above; hole boring excavation in ordinary ground can be efficiently performed by independently performing rotary excavation using the excavating bit. In cases where hard ground is struck, percussive excavation using a percussive body can be added, so that hard ground boring in which the hole boring efficiency using the excavating bit is poor can also be efficiently performed.

Furthermore, since an externally operated switching valve is installed in the auger head for the liquid discharge path and high pressure air supply path, although the work of withdrawing the earth auger is somewhat increased, the excavating rod is inexpensive compared to that of a conventional earth auger provided separately with a liquid supply path; furthermore, the connection of the excavating rod is also easy, and the respective operations can be reliably performed.

DESCRIPTION OF THE PREFERRED EMBODIMENTS

Figure 1:
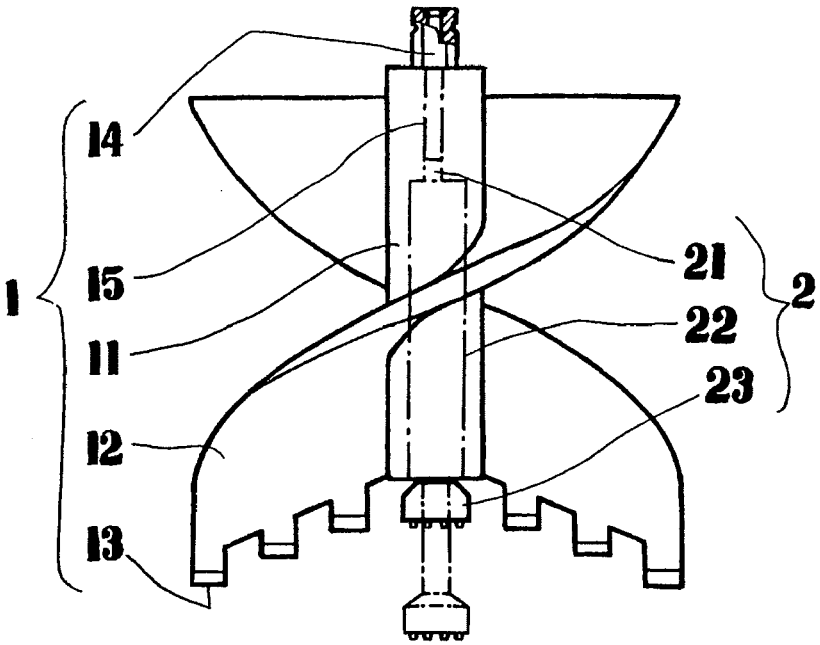
FIG. 1 is an overall view of a first embodiment of the present invention.
Figure 2:
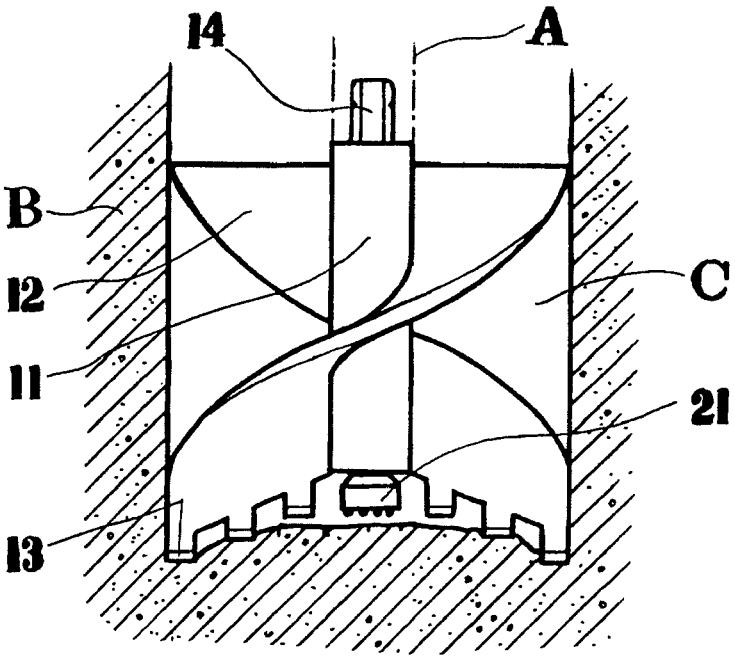
FIG. 2 is an explanatory diagram of the conditions of use of the same (ordinary excavation)
Figure 3:
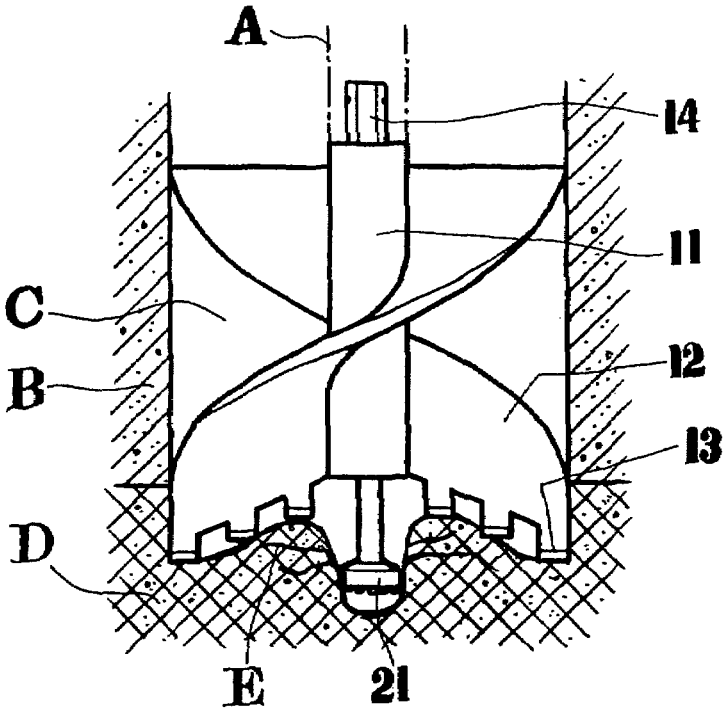
FIG. 3 is an explanatory diagram of the conditions of use of the same (hard ground excavation)

Next, embodiments of the present invention will be described. FIGS. 1 through 3 show a first embodiment; this earth auger head comprises a rotary excavation mechanism part 1 and a percussive excavation mechanism part 2.

The rotary excavation mechanism part 1 has a construction that is basically similar to that of a conventional earth auger head. A spiral vane 12 used to discharge earth is disposed on the outer circumference of a rotary tubular part 11, and an excavating bit 13 whose outer circumferential side protrudes further downward than the central side is disposed on the lower end of this spiral vane 12. In particular, the excavating bit 13 has a structure in which the outer circumferential part protrudes further downward than the central side.

Furthermore, an excavating rod A and a connecting shaft part 14 are disposed on the upper end of the rotary tubular part 11, and a high pressure air supply path 15 which acts as a driving source for the percussive excavation mechanism part 2 (described later) is installed inside the rotary tubular part 11 and connecting shaft part 14.

The percussive excavation mechanism part 2 is an excavation mechanism with air pressure driving called a "down-the-hole hammer". A high pressure air supply part 21 is disposed on the top part, and a main body part 22 is built into the rotary tubular part 11 so that the abovementioned high pressure air supply part 21 is connected with the high pressure air supply path 15. This has a structure which is such that when high pressure air is supplied, a percussive body 23 with an excavating bit 13 installed in an upright position on the tip end protrudes at a high speed, and when the percussive body 23 strikes the excavation surface, the switching of the valve is effected by the shock (reaction), high pressure air is caused to jet from the opening part in the percussive body 23, a powder of the excavated hard ground is discharged by the air stream, and the percussive body 23 returns. Excavation proceeds by the repetition of this operation.

Furthermore, this is built into the rotary tubular body 11 so that the accommodation position of the percussive body 23 is higher than the lower tip end of the abovementioned excavating bit 13, and so that the percussive protruding position is lower than the lower tip end of the excavating bit 13 (by approximately 20 cm in the case of the external dimensions described below).

Furthermore, the external diameter of the percussive body 23 is set at a value that is ⅓ the external diameter of the excavating bit 13 or less. For example, when an excavated hole having an external diameter of 500 mm is bored, the external diameter of the percussive body 23 is set at 150 mm. In a case where the abovementioned dimensions are used, if an excavated hole having a diameter of 500 mm is bored entirely using the down-the-hole hammer, the amount of air consumption required for driving is 43 cubic meters per minute. When the diameter is set at 150 mm, it is sufficient if the amount of driving air consumption is set at 9 cubic meters per minute.

Furthermore, in the excavation method of the present invention using the abovementioned earth auger head of the first embodiment, as in a conventional excavation method, an earth auger is constructed in which a discharge screw and a retaining plate used to compact the walls of the hole are disposed on the outer circumference, and this is mounted on the tip end of a specified excavating rod containing a supply path for high pressure air used to drive the percussive excavation mechanism part 2, the abovementioned excavating rod is connected to a rotary driving mechanism and suspended by means of a specified variety of heavy machinery or the like, and hole boring excavation is performed. The system is contrived so that the operating control of the rotary excavation mechanism and the operating control of the percussive excavation mechanism are performed independently.

Accordingly, in the excavation of ordinary ground B, hole boring excavation is performed by actuating only the rotary driving mechanism; in this excavation, the outer circumferential portion of the excavated hole C is dug out by the excavating bit 13, and in the central portion of the excavated hole C with respect to the cutting vane, the earth is broken down by digging using the excavating bit 13 disposed on the inside, and the excavated earth is discharged by the spiral vane 12.

When the excavated ground reaches hard ground D, the progress of excavation by the excavating bit 13 is slowed, and the breaking down of the earth by the cutting vane in the excavated hole C becomes difficult, so that the speed at which the excavation progresses is slowed. When this slowing is detected, the percussive excavation mechanism part 2 is actuated.

When the percussive excavation mechanism part 2 is actuated, the percussive body 23 applies a shock to the hard ground D, the hard ground D is pulverized, and excavation is caused to proceed by the generation of cracks E.

Thus, ordinary excavation is accomplished by actuating the rotary excavation mechanism part 1, and the percussive excavation mechanism part 2 is actuated only in places where excavation by the excavating bit 13 is difficult. Furthermore, since the percussive excavation mechanism part 2 is formed with a small diameter, the amount of driving air required is correspondingly reduced. Accordingly, expenditures on accessory equipment are also reduced, and the method is superior overall from the standpoint of economic efficiency, and the standpoint of operating efficiency.

Figure 4:
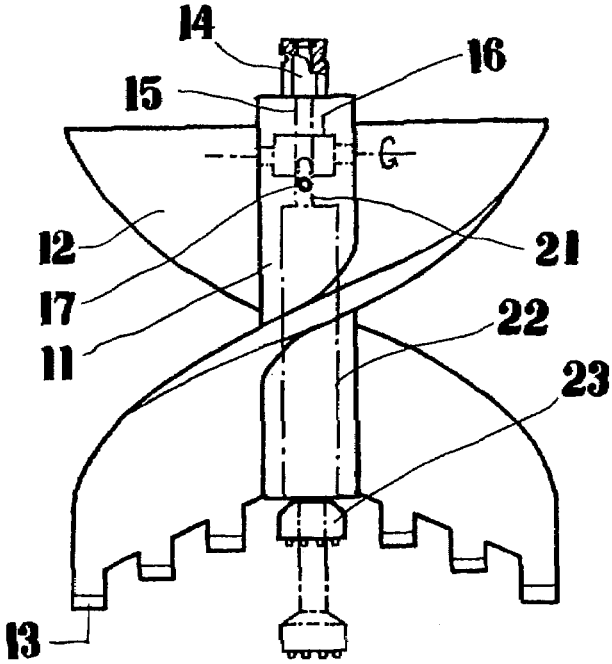
FIG. 4 is an overall view of a second embodiment of the same.
Figure 5:
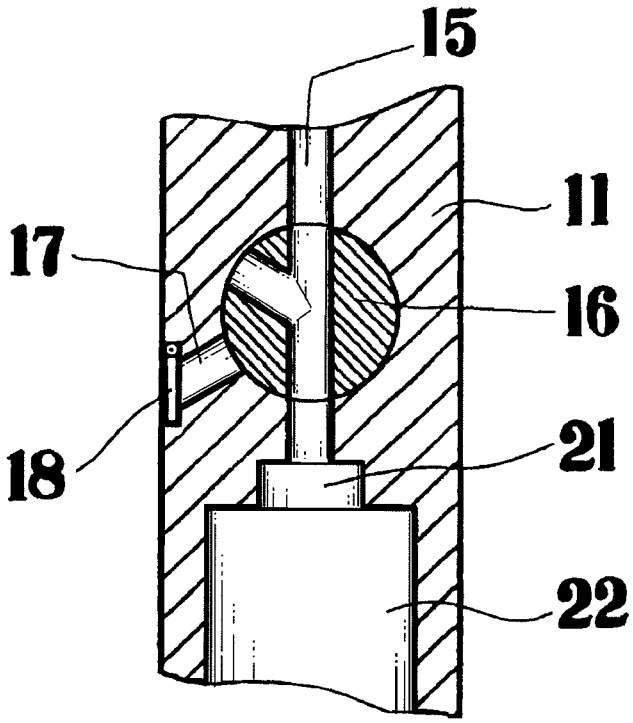
FIGS. 5(*a*) and 5(*b*) are explanatory diagrams of the switching valve of the same.
Figure 5:
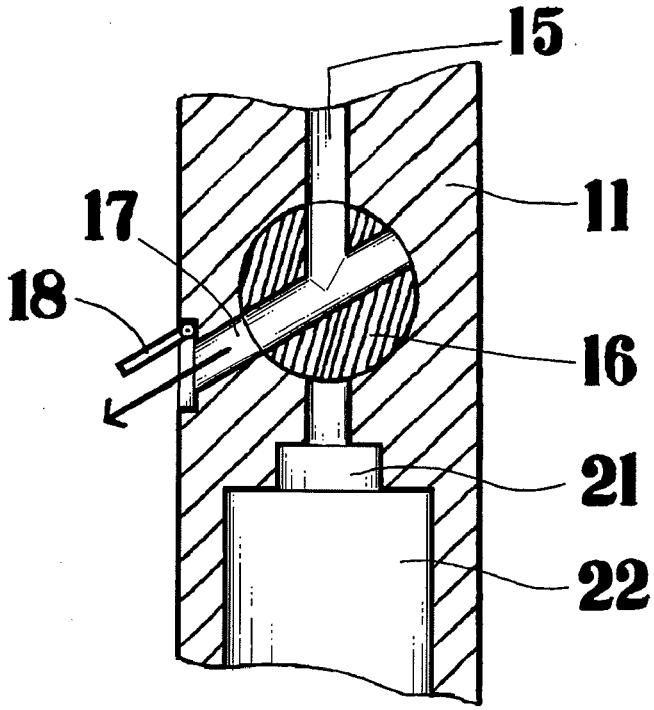

The earth auger head shown in FIGS. 4 and 5 is a second embodiment of the present invention. The basic structure is the same as that of the abovementioned first embodiment. In particular, a switching valve 16 is interposed at an intermediate point in the high pressure air supply path 15 inside the rotary tubular part 11. Furthermore, a liquid discharge path 17 is provided which opens on the outer circumference of the rotary tubular part and which is connected with the high pressure air supply path 15 by the abovementioned switching valve 16. A check valve 18 is disposed on the open end of the liquid discharge path 17.

In particular, the abovementioned switching valve 16 is actuated either manually or mechanically, and is devised so that a switching operation is performed by operation from the outside.

The excavation method of the present invention in the abovementioned second embodiment using the earth auger head of the first embodiment is made up of a hole boring excavation operation and a foot protection liquid filling operation.

In the hole boring excavation work, the valve body of the switching valve 16 is placed in a position which is such that high pressure air is supplied to the percussive excavation mechanism part 2 (FIG. 5(*a*)), and excavation is performed in the same manner as in the abovementioned first embodiment. In particular, a switching operation is performed only by the external operation of the switching valve 16; accordingly, there is no unintentional operation of the switching valve 16 during the excavation work, and appropriate hole boring excavation is performed.

When the abovementioned hole boring excavation is completed, the earth auger (in a state in which the excavating rod A and auger head are connected) is temporarily withdrawn from the excavated hole C, the switching valve 16 is operated at the ground surface so that the high pressure air supply path 15 and liquid discharge path 17 are caused to communicate, the auger head is again inserted into the excavated hole B, and the earth auger is lowered to the bottom of the hole.

In the abovementioned state, the earth auger is successively withdrawn while a foot protection liquid such as cement milk or the like is supplied to the high pressure air supply path 15 from the ground surface, and the hole is filled with this foot protection liquid in a state in which the excavated hole C is maintained.

Accordingly, compared to a conventional earth auger in which the high pressure air path and liquid supply path are formed as two parts in the excavating rod and earth auger head, an all-purpose excavating rod can be used, and, considering the bothersome nature of the earth auger formation operation (excavating rod connection operation) and inexpensive cost of the members (auger head and excavating rod), the embodiment is sufficiently superior in overall terms even if there is an increase in the work of pulling out and reinserting the earth auger.

Furthermore, compared to a conventional earth auger head equipped with an automatic switching mechanism depending on the weight of the earth auger head, considering the occurrence of unsatisfactory operation of the switching valve in the cutting vane in which dust and small stones are thrown up, the embodiment is sufficiently superior in terms of overall working characteristics even if there is an increase in the work of withdrawing and re-inserting the earth auger.

What is claimed is:

1. An earth auger head comprising:

a rotary excavation mechanism part in which a spiral vane used to discharge earth is provided to an outer circumference of a rotary tubular part, and in which an excavating bit whose outer circumferential side protrudes flirt her downward than the central side is provided to a lower end of the spiral vane; and a pneumatic percussive excavation mechanism part that is installed inside the rotary tubular part and is disposed so that a percussive body is accommodated in a position that is higher than the lower tip end of the excavating bit, wherein an excavating rod connecting part is provided to the upper part of the rotary tubular part of the rotary excavation mechanism part, a high pressure air supply path is formed communicating between the connecting part and a high pressure air supply part in the internally installed percussive excavation mechanism part, a switching valve that is operated by an external operation is disposed at an intermediate point along the high pressure air supply path, and a liquid discharge path is formed so as to open on the outer circumference of the rotary tubular part connected with the high pressure air supply path via the switching valve.

2. The earth auger head according to claim 1, wherein the external diameter of the percussive body in the percussive excavation mechanism is ⅓ the external diameter of the excavating bit or less.

3. The earth auger head according to claim 1, wherein the switching valve is a manual switching structure.

4. An excavation method comprising:

forming an earth auger by connecting a prescribed excavating rod and an earth auger head having a rotary excavation mechanism part in which a spiral vane used to discharge earth is provided to an outer circumference of a rotary tubular part, and in which an excavating bit whose outer circumferential side protrudes further downward than the central side is provided to a lower end of the spiral vane, and further having a pneumatic percussive excavation mechanism part that is installed inside the rotary tubular part and is disposed so that a percussive body is accommodated in a position that is higher than the lower tip end of the excavating bit; and independently driving and controlling the rotary excavating mechanism part and the percussive excavation mechanism part when hole boring excavation is performed, wherein an excavating rod connecting part is provided to the upper part of the rotary tubular part of the rotary excavation mechanism part, a high pressure air supply path is formed communicating between the connecting part and a high pressure air supply part in the internally installed percussive excavation mechanism part, a switching valve that is operated by an external operation is disposed at an intermediate point along the high pressure air supply path, and a liquid discharge path is formed so as to open on the outer circumference of the rotary tubular part connected with the high pressure air supply path via the switching valve.

5. An excavation method comprising:

forming an earth auger by connecting a prescribed excavating rod and an earth auger head having a rotary excavation mechanism part in which a spiral vane used to discharge earth is provided to an outer circumference of a rotary tubular part, and in which an excavating bit whose outer circumferential side protrudes further downward than the central side is provided to a lower end of the spiral vane, and further having a pneumatic percussive excavation mechanism part that is installed inside the rotary tubular part and is disposed so that a percussive body is accommodated in a position that is higher than the lower tip end of the excavating bit, wherein an excavating rod connecting part is provided to the upper part of the rotary tubular part of the rotary excavation mechanism part, a high pressure air supply path is formed communicating between the connecting part and a high pressure air supply part of the internally installed percussive excavation mechanism part, a manual switching valve is disposed at an intermediate point along the high pressure air supply path, and a liquid discharge path is formed so as to open on the outer circumference of the rotary tubular part connected with the high pressure air supply path via the switching valve;

forming an excavated hole having a specified depth by independently driving and controlling the rotary excavation mechanism part and percussive excavation mechanism part when the earth auger is used to perform hole boring excavation;

subsequently withdrawing the earth auger from the excavated hole;

operating the switching valve to establish communication between the high pressure air path and the liquid discharge path;

lowering the earth auger once more to the bottom of the excavated hole;

delivering a foot protection liquid such as cement milk or the like to the high pressure air supply path; and discharging the foot protection liquid into the excavated hole while the earth auger is withdrawn.

6. The earth auger head according to claim 2, wherein the switching valve is a manual switching structure.

* * * * *